United States Patent [19]

Shine

[11] 4,108,234

[45] Aug. 22, 1978

[54] METHOD AND MACHINE FOR PRODUCING SAND MOLDS

[76] Inventor: Thomas R. Shine, 782 Richards Rd., Wayne, Pa. 19087

[21] Appl. No.: 788,813

[22] Filed: Apr. 19, 1977

[51] Int. Cl.[2] ..... B22C 17/00; B22C 17/08

[52] U.S. Cl. ..... 164/38; 164/39; 164/182; 164/183; 164/203; 164/214

[58] Field of Search ..... 164/29, 182, 183, 185, 164/38, 203, 205, 213, 214, 223, 224

[56] References Cited

U.S. PATENT DOCUMENTS

| | | | |
|---|---|---|---|
| 2,012,478 | 8/1935 | Oyster et al. | 164/182 |
| 3,229,336 | 1/1966 | Hunter et al. | 164/182 X |

*Primary Examiner*—Francis S. Husar
*Assistant Examiner*—John S. Brown
*Attorney, Agent, or Firm*—Eugene Chovanes

[57] ABSTRACT

A machine for producing sand molds by a single operator, wherein the flask assembly, including the cope, drag and matchplate remain in the machine at all times, and the method utilized therein.

2 Claims, 19 Drawing Figures

METHOD AND MACHINE FOR PRODUCING SAND MOLDS

BACKGROUND OF THE INVENTION

Sand molds are used extensively by foundries for casting metal. Such molds have formed therein the shape to be cast.

The preparation of these molds is well known and involves essentially the use of a flask consisting of an upper cope and a lower drag with a match plate having the desired mold shape thereon. The mold is formed in the flask.

The preparation of the mold involves numerous steps including the assembling of the flask with the matchplate between the cope and drag, the filling of the cope and drag with sand, proper jolting, settling and squeezing of the sand, and removal of the matchplate and flask from the mold.

The flask is moved from a first machine where the mold is formed, to a second machine, where the mold is stripped from the flask. The handling of the flask and the sand mold requires much time and effort to avoid damaging the relatively fragile, but bulky and heavy, sand mold.

The molds, and the flask for producing such molds, are of great weight, so it is necessary to use machines to perform the required steps. For instance, prior art machines have filled, jolted, and settled the sand, and other machines have been used to remove the flask, with the sand therein, from the first machine. Still other machines have been used to strip the flask from the mold.

SUMMARY OF THE PRESENT INVENTION

The molding machine of the present invention, with a single operator, performs all of the steps necessary to produce a finished sand mold. It eliminates the need for overhead cranes, slings, and another operator. Costly flask, mold and matchplate handling time is virtually eliminated, doubling or tripling the mold output in a single shift.

In the present invention, the flask stays with the machine at all times. The flask is filled with sand from, for instance, an overhead hopper, and then suitably settled by jolting, and squeezed. The cope, drag, and matchplate are removed from the mold, within the machine, and the finished sand mold is available for removal from the machine.

Thus the machine of the invention becomes a complete cycle semi-automatic, high production molding machine. The machine of the present invention has among other elements, vertically movable arms that selectively lift and lower the complete flask assembly in some instances, and in other instances, the movable arms cooperate with a cope clamp mechanism to separate the cope and drag to permit removal of the matchplate and subsequent joinder of parts of the mold, after which the operator strips the flask from the finished mold.

BRIEF DESCRIPTION OF THE DRAWINGS

FIG. 12 shows the machine at the start of the molding cycle.

FIG. 13 shows the lift arms raised to permit rollover of the suspended flasks.

FIG. 14 shows the sand in the mold being squeezed.

FIG. 15 shows the lift arms raised, with the cope being secured at the top of the machine.

FIG. 16 shows the drag at its lower position, with the matchplate being held out of the mold.

FIG. 17 shows the matchplate swing to one side of the machine.

FIG. 18 shows the cope and drag being held at the top of the machine and the sand mold deposited on a conveyor.

FIG. 19 shows the cope at the top of the machine, the drag at the lowest position, and the matchplate suspended midway, prior to assembly of the flask.

DESCRIPTION OF PREFERRED EMBODIMENT

Figure 1:
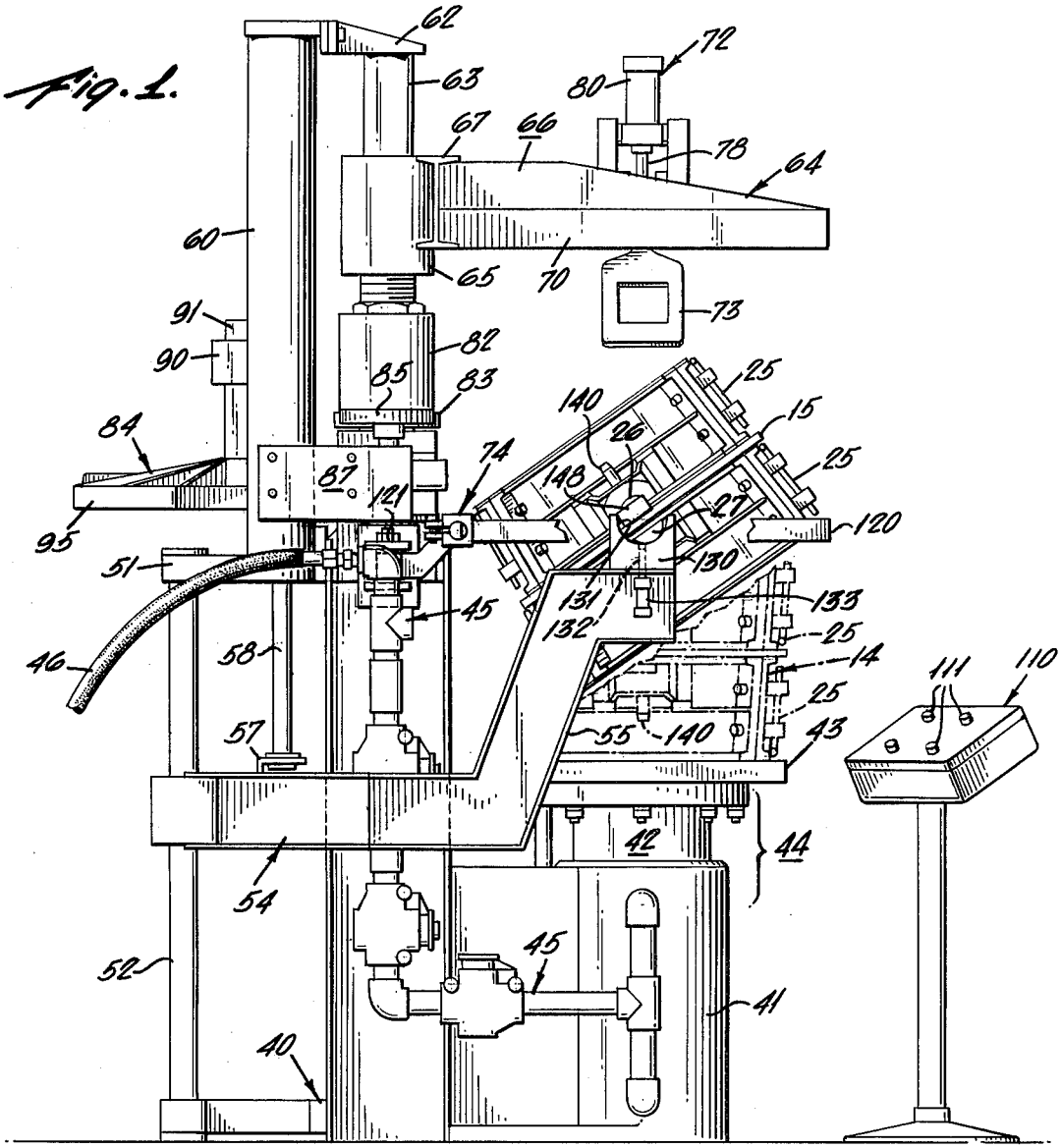
FIG. 1 is a right side elevation of the machine of the invention.
Figure 6:
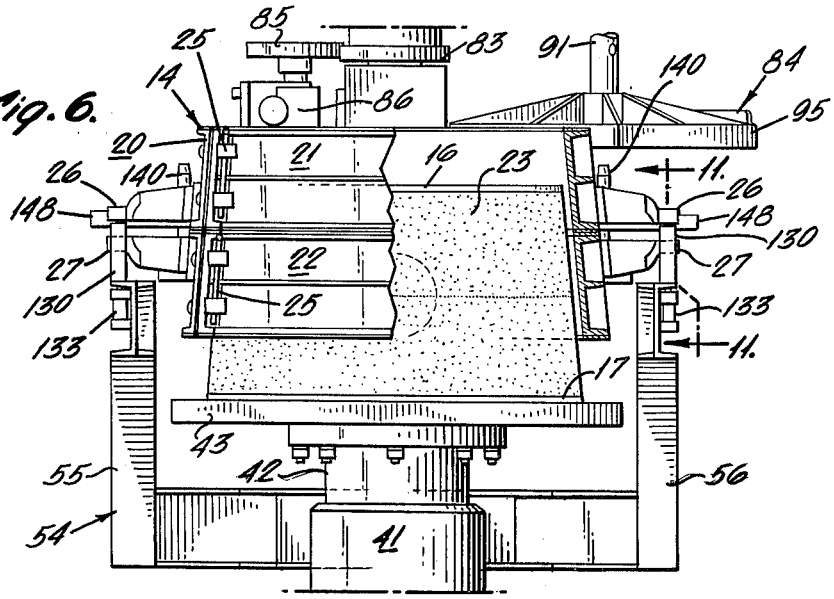
FIG. 6 is a fragmentary front elevation showing a further step in the operation.
Figure 3:
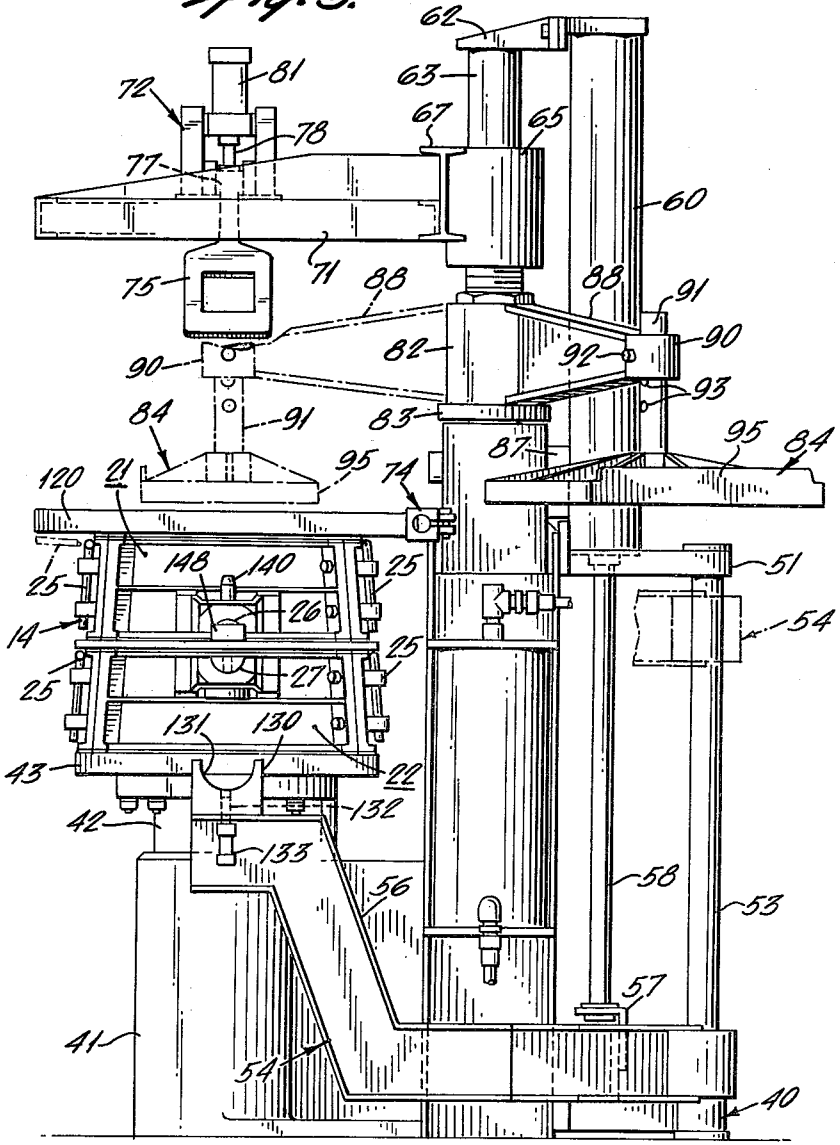
FIG. 3 is a left side elevation of the machine of the invention.
Figure 2:
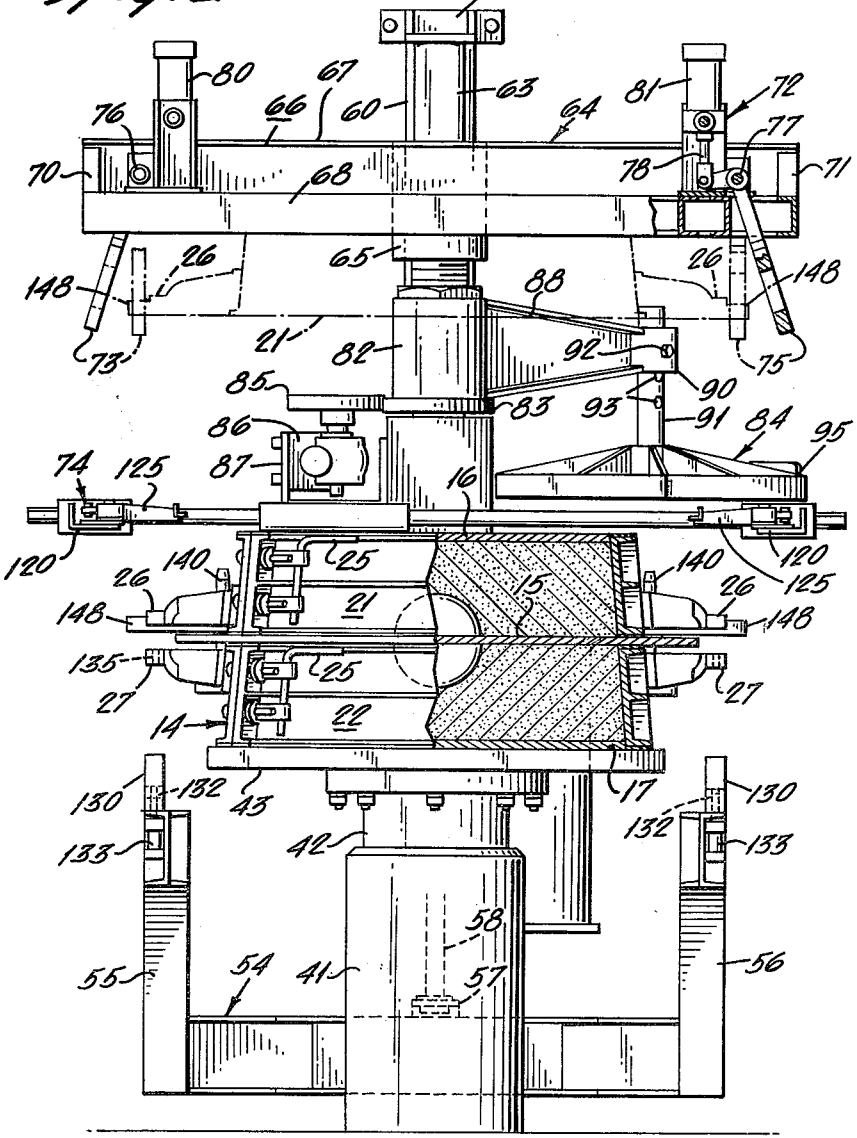
FIG. 2 is a front elevation of the machine of the invention.
Figure 4:
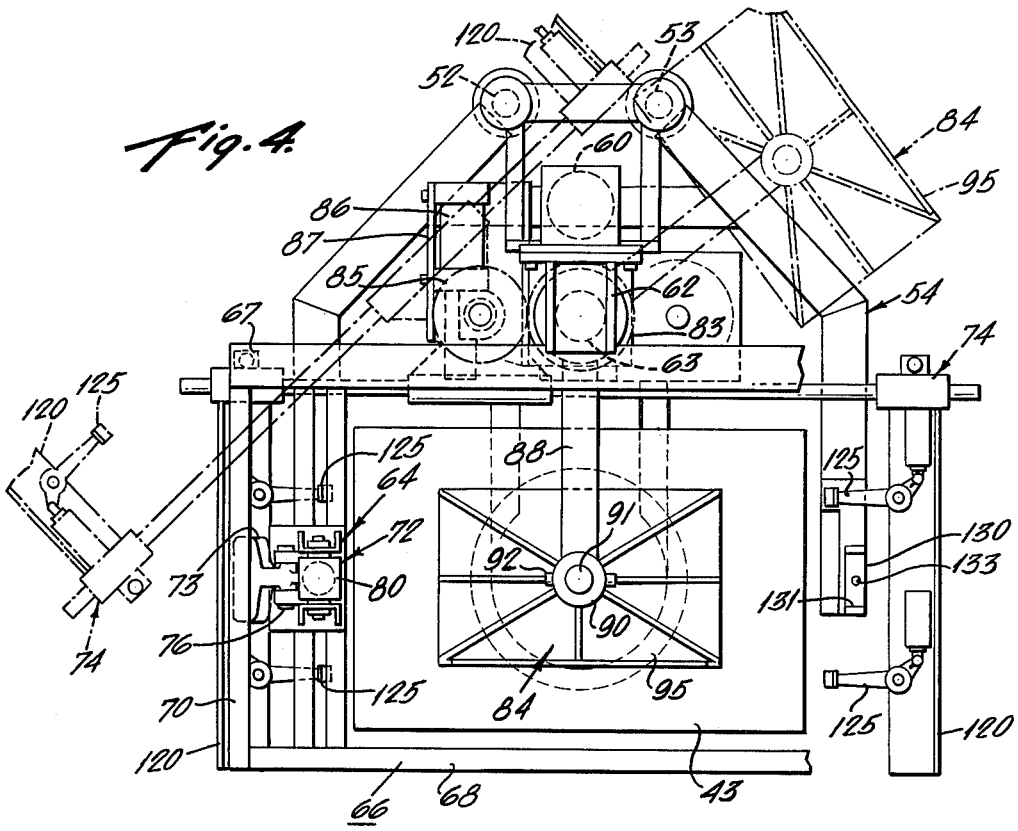
FIG. 4 is a top plan view of the machine of the invention.
Figure 5:
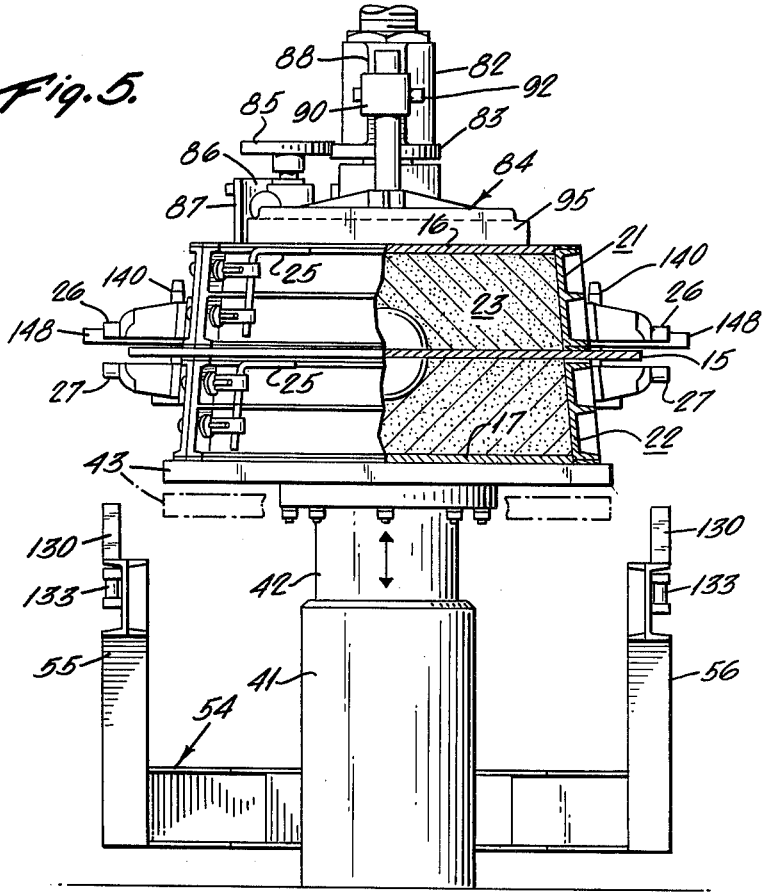
FIG. 5 is a fragmentary elevation as viewed from the front showing a step in the operation.
Figure 8:
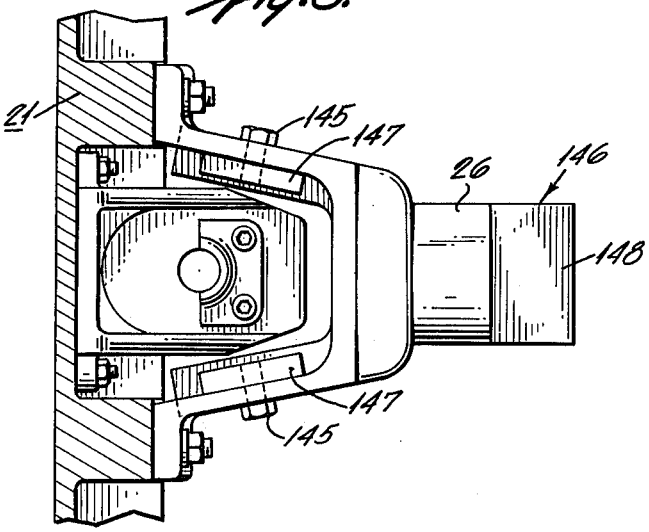
FIG. 8 is a plan view of FIG. 7.

In flask assembly 14, the flask 20 is of prior art slip or snap type wherein the cope 21 and drag 22 can be taken off without affecting the sand mold 23 by releasing clamps 25 at the corner, thus opening up the flask. The flask 20 has special trunnions 26 and 27, as seen particularly in FIGS. 8 to 11, which are attached respectively to cope 21 and drag 22 of flask 20. A matchplate 15, having thereon the shape of the item to be molded extends between cope 21 and drag 22 in flask assembly 14 while the mold 23 is being formed.

The machine of the invention consists essentially of a base 40, a jolt and squeeze table assembly 44, a vertical lift and rollover assembly 54, a cope clamp assembly 64, a matchplate handler assembly 74, an upper squeeze head mechanism 84, and air under pressure for selectively activating the assemblies and mechanisms. These assemblies cooperate to produce the desired sand molds.

A jolt and squeeze table assembly 44, supported on base 40, includes main double acting pneumatic cylinder 41 having extended therefrom piston 42 which has affixed thereto a jolt and squeeze table 43. Air distribution system 45 feeds double acting cylinder 41 with high pressure air from main air inlet 46. The table 43, during the jolting phase of the operation of the machine reciprocates rapidly, vertically, through a short distance, by air supply and exhaust intermittently under piston 42 in the well known manner.

During the squeeze phase of the operation, the table 43 cooperates with fixed upper squeeze head 95 to squeeze the sand within the flask. Piston 42 forces table 43 upward, under the desired pressure, against the upper squeeze head 95.

During the squeeze, the table 43 may optionally be simultaneously jolted, by air under pressure activating a jolt hammer inside the squeeze piston 42, as well known in the prior art.

In lift and rollover arm assembly 54, cylinder 60 extends from plate 51 which is supported by vertical guide shafts 52 and 53 having mounted thereon for vertical movement lift arms 55 and 56. Arms 55 and 56 are connected by bracket 57 having secured thereto piston rod 58 extending from pneumatic cylinder 60 supported from plate 51. Air cylinder 60 is suitably fed from high pressure air system 45.

Figure 10:
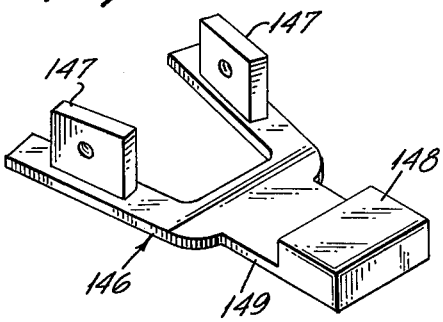
FIG. 10 is a perspective view of the trunnion adaptor shown in FIGS. 7, 8 and 9.
Figure 7:
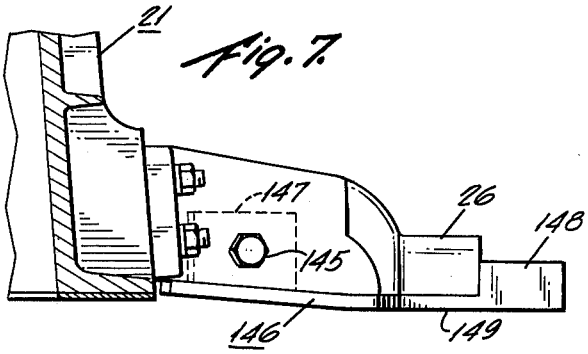
FIG. 7 is a fragmentary side elevation of a modified split trunnion assembly of the flask.
Figure 9:
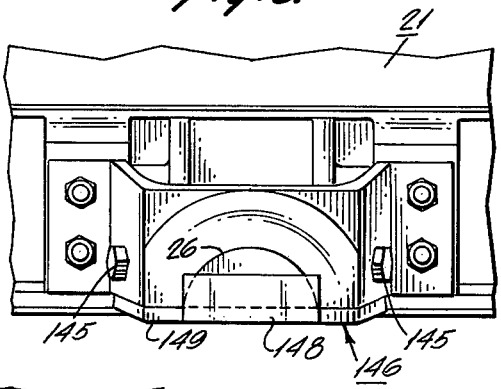
FIG. 9 is an end elevation of FIG. 7.
Figure 11:
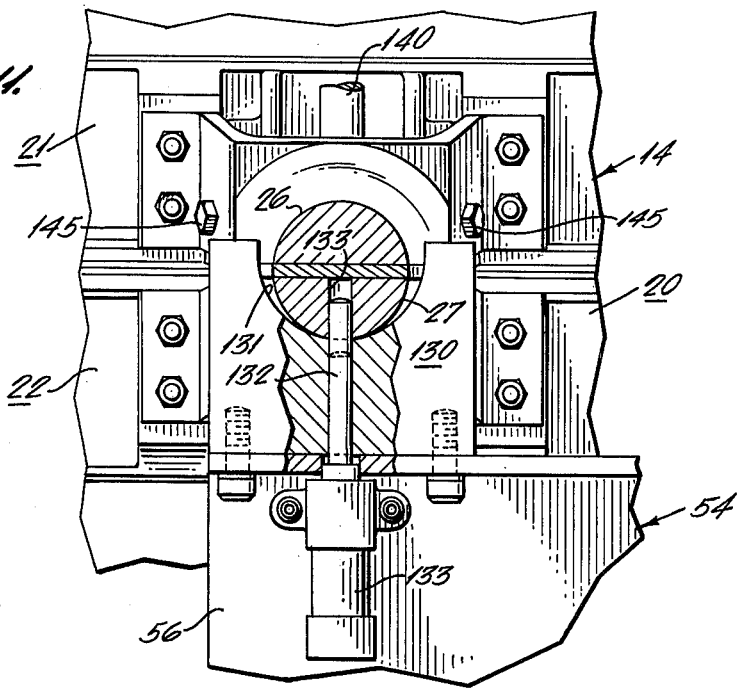
FIG. 11 is a sectional view taken on line 11—11 of FIG. 6.

Arms 55 and 56 have thereon blocks 130 having an arcuate bearing surface 131 which receives trunnions 26 and 27. Pin 132 is slidably mounted on each of the arms, and is acuated by pneumatic piston 133 which is connected to the main air supply through controls 110. Trunnions 27 have an alignment hole 135 therein which is intended to selectively receive pin 132, whereby trunnions 26 and 27 are rotatably secured to lift arms 55 and 56. Fixed alignment pins 140 in the trunnions 26 and 27 keep cope 21 and drag 22 aligned to one another. Cope trunnion 26 has secured thereto by bolts 145 cope ears 146 as seen in FIG. 10 having flanges 147 through which bolts 145 extend, and a rectangular block portion 148 extending from segment 149.

In cope clamp mechanism 64, bracket 62 extends from cylinder 60 and supports the top of cylindrical shaft 63 which has suitably affixed thereto journal 65 having integrally extended therefrom frame 66 having longitudinal members 67 and 68 and transverse members 70 and 71. Frame 66 has extending therefrom a cope clamp mechanism 72 having arms 73 and 75 pivoted at 76 and 77. A bell crank on each arm is connected to piston 78 extending from air cylinders 80 and 81 which in turn are connected to the air distribution system 45.

In the upper squeeze head mechanism 84, journal 82 is rotatably mounted at the lower end of the shaft 63 and has fixed thereon gear 83, engaging pinion 85 rotatably driven by air motor 86 mounted on bracket 87. Air motor 86 is suitably connected to air distribution system 45. Extending from journal 82 and integral therewith, is arm 88 having at the end thereof journal 90 slidably mounting shaft 91 which is adjustably fixed to journal 90 by pin 92 extending into one of a plurality of holes 93. A fixed upper squeeze head 95 is fixed at the lower end of shaft 91.

In matchplate clamp assembly 74, the control stand 110 with various controls 111 activate the air system to selectively pass high pressure air into a pneumatic cylinder which selectively rotates frame 120 from pivot 121 on base 40. Frame 120 has extending therefrom a pair of grab arms 125 which are activated by pneumatic cylinders to selectively rotate and grab matchplate 15 during machine operation.

The steps in the operation of the machine are shown in FIGS. 12 to 19 inclusive.

Figures 12, 13, 14, 15, 16, 17, 18, 19:
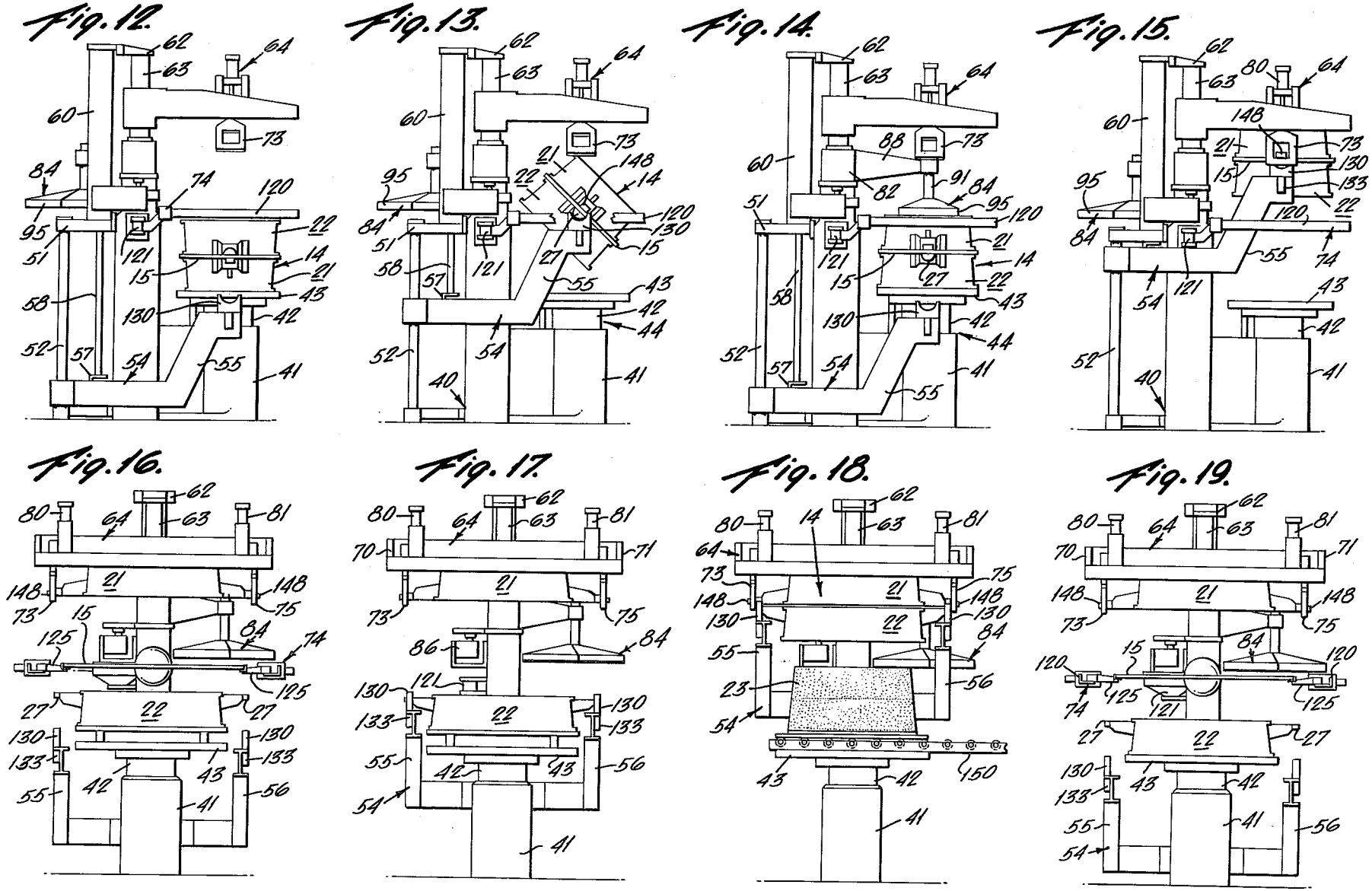
FIGS. 12 through 19 show, schematically, the method and machine of the invention in the various steps of a molding cycle.

FIG. 12 shows the start of the cycle wherein table 43 is in a downward position, with no force being exerted on the table by piston 42. The flask assembly 14 is resting on the table in an inverted position with the drag up. The matchplate 15 extends between the cope 21 and drag 22. Neither the top nor bottom plate are in position. The arms 55 and 56 are in a downward position. The upper squeeze head mechanism 84 and the matchplate clamp assembly 74 are rotated out of the way.

The operator fills the drag 22 with sand from an overhead hopper, and then activates the jolt mechanism with controls 111. Table 43 reciprocates rapidly and settles the sand. The operator then places the bottom board 17.

As seen in FIG. 13, the operator then operates controls 111 to raise lift arms 55, picking up flask 14 at trunnions 26 and 27, to the required height above table 43 for flask rollover. The operator rolls flask 14 manually, and then activates controls 110 to lower lift arms 55 and flask 14 back down to table 43 with the cope 21 up.

As seen in FIG. 14, cope 21 is filled with sand, optionally jolted once again, top board 16 is set in place and the operator activates pneumatic valve controls 110, automatically swinging in squeeze head 84 by activation of air motor 86, raising piston 42 and table 43 to squeeze up the mold, and optionally activating simultaneous jolt of table 43 when squeeze pressure is reached.

The operator then activates controls 111 to lower the squeeze piston 42 and table 43, and retract swing head 95.

The squeezing and jolting of the flask 14 are generated from the table assembly 44 which has, as indicated above, a pneumatic cylinder 41 and piston 42 arrangement.

The operator then activates controls 111 on control panel 110, raising the lock pins 132 in lift arms 55 and 56 of arm assembly 54. The lift arms 55 and 56 are then vertically raised. Flask assembly 14 is picked up at trunnions 26 and 27 and raised to the full-up position as shown in FIG. 15. The lock pins 132 keep the flask 14 level, even if the mold pattern is unbalanced. Arms 73 and 75 of cope clamp mechanism 64 are then swung down by means of controls 111, to secure the cope 21 by means of blocks 148 on ears 146, in a level upper position. The lift arms 55 and 56 are then lowered, drawing the drag 22 and matchplate 15 down from cope 21.

In the next step as shown in FIG. 16, the operator activates the control panel 110 to swing the match plate grab arms 125 into position, thus holding the matchplate 15 level while the drag 22 drops down to the table 43. As the lift arms 55 and 56 come to rest, the matchplate clamp assembly 74 and matchplate 15 swing on pivot 121 to one side of the machine, out of the way. The sand is held in place in cope 21 through the action of the binder used in molding sand.

While the cycle is at the position shown in FIG. 17, the cope 21 and drag 22 are blown off by air and any cores are set, controls 111 are activated to raise lift arms 55 and 56, with lock pins 132 still up, thus raising drag 22 up, to reunite with cope 21 and close the mold. After closing, the cope arms 73 and 75 retract, releasing cope 21. The operator lowers the lift arms 55 and 56 and closed mold back down to table 43.

Prior to the closed mold returning down to the table 43, a short conveyor section 150 is moved into place from the side of the machine onto table 43, enabling the mold to be set on it.

The operator then snaps open both cope 21 and drag 22 by means of clamps 25, and raises lift arms 55 and 56. Arms 55 and 56, through trunnions 26 and 27, strip flask 14 cleanly off mold, as seen in FIG. 18. While flask 14 is in full-up position, the operator rolls the mold 23 off of the machine on the conveyor section 150 provided.

The conveyor section 150 is then retracted out of position after the mold 23 has been rolled off.

While the flask is in the raised position of FIG. 18, the operator activates the controls 111, whereby cope arms 73 and 75 swing into clamping engagement with block 148 on ears 146 on cope trunnions 26 and 27. The operator lowers lift arms 55 and 56 and drag 22 back down to the table, allowing the matchplate assembly 74 and matchplate 15 to swing back into position, as also shown in FIG. 19. The operator then raises lift arms 55 and 56 and drag 22 back up, picking up matchplate 15, and retracting matchplate grab arms 125. Drag 22 and matchplate 15 reunite with empty cope 21, and cope clamps 73 and 75 release. The empty flask 14 is lowered, rolled over, and cope 21 is snapped tight through clamps 25 and brought to rest on table 43 for a new cycle.

In view of my invention and disclosure, variations and modifications to meet individual whim or particular need will doubtless become evident to others skilled in the art to obtain all or part of the benefits of my invention without copying the machine and method shown, and I, therefore, claim all such insofar as they fall within the reasonable spirit and scope of my claims.

I claim:

1. The method of producing a sand mold in a flask assembly having a cope and drag with trunnions thereon, and a matchplate, comprising:

a. supporting the flask assembly drag up with sand in the drag;
b. jolting the flask assembly to settle the sand within the drag;
c. placing a bottom board on top of the drag sand;
d. vertically picking up the flask assembly at the trunnions and rolling the flask assembly over to place the flask assembly in a cope-up position, and lowering the flask assembly vertically back down, to receive sand within the cope;
e. filling the cope with sand;
f. squeezing the sand within the flask assembly;
g. vertically raising the flask assembly to an upper position, and retaining the cope by means of the cope trunnions, with the squeezed sand therein, at said upper position;
h. lowering, in a vertical direction only, the drag, with the squeezed sand therein, and the matchplate, to a position below the cope;
i. removing the matchplate from the drag and swinging it to one side of the drag;
j. vertically raising the drag and sand therein up to the cope to reunite the drag to the cope to form the completed sand mold;
k. vertically lowering the cope and drag and sand mold therein to a lower position; and
l. opening the cope and drag flasks and raising vertically the cope and drag flask to an upper position, while allowing the sand mold to remain at the lower position, wherein all movements of the cope and drag are limited to vertical movement only.

2. In combination with a flask assembly that includes a cope and drag with trunnions thereon, and a matchplate;

a machine for producing sand molds comprising:

a. a table supporting the flask assembly drag up with sand in the drag;
b. means connected to said table for jolting the table, and the flask assembly supported thereon, to settle the sand within the drag;
c. lift arms engaging said trunnions and
   1. having means locking said arms to said trunnions,
   2. limited to vertical movement, and
   3. extending substantially horizontally in cantilevered fashion in a direction from the rear of said table;
d. drive means connected to said lift arms for moving the lift arms vertically;
e. means operatively associated with said drive means for selectively operating the drive means and selectively moving the lift arms vertically for:
   1. raising the flask assembly at the trunnions to clear the table whereby the flask assembly can be rolled over on the trunnion to place the flask in a cope-up position to receive sand within the cope,
   2. lowering the flask assembly back down to the table,
   3. raising the flask assembly from the table to a position adjacent the cope clamp means,
   4. lowering the drag with the bound sand therein and the matchplate to a position below the cope when the cope is clamped at the upper part of the machine,
   5. raising the drag and sand therein to the top of the machine to reunite the drag to the cope to form the completed sand mold,
   6. lowering the drag and cope with the sand mold therein onto the table, and
   7. raising the drag and cope without the sand mold therein, above the table, with the finished sand mold remaining on the table;
f. a squeeze head mounted for selective positioning above the flask assembly which cooperates with the table to squeeze the sand within the flask;
g. cope clamp means at the upper part of the machine for retaining and clamping the cope by means of the cope trunnions, with the squeezed sand therein, at the upper part of the machine;
h. means operatively associated with said matchplate for clamping the matchplate and moving the matchplate to one side, away from the cope and drag on the machine; and
i. means operatively associated with said cope clamp means to release the cope clamp means to permit the cope to be supported by the raised lift arms; wherein a finished sand mold is produced by the machine while the flask assembly and matchplate remain in the machine at all times.

* * * * *